US006115943A

United States Patent [19]

Gyr

[11] Patent Number: 6,115,943

[45] **Date of Patent: *Sep. 12, 2000**

[54] FOOTWEAR HAVING AN ARTICULATING HEEL PORTION

[76] Inventor: Kaj Gyr, 1807 NE. 52d Ave., Portland, Oreg. 97213

[ * ] Notice: This patent issued on a continued prosecution application filed under 37 CFR 1.53(d), and is subject to the twenty year patent term provisions of 35 U.S.C. 154(a)(2).

[21] Appl. No.: 09/123,562

[22] Filed: Jul. 28, 1998

Related U.S. Application Data

[63] Continuation-in-part of application No. 09/105,974, Jun. 26, 1998, which is a continuation of application No. 08/538,754, Oct. 2, 1995, abandoned.

[51] Int. Cl.[7] ..... A43B 21/26

[52] U.S. Cl. ..... 36/35 R; 36/28

[58] Field of Search ..... 36/35 R, 38, 28, 36/27, 7.8

[56] References Cited

U.S. PATENT DOCUMENTS

| | | | |
|---|---|---|---|
| 4,534,124 | 8/1985 | Schnell | 36/7.8 X |
| 4,546,555 | 10/1985 | Spademan | 36/28 |
| 4,566,206 | 1/1986 | Weber | 36/7.8 |
| 4,592,153 | 6/1986 | Jacinto | 36/38 |
| 4,843,737 | 7/1989 | Vorderer | 36/38 |
| 5,365,678 | 11/1994 | Shibata | 36/28 X |
| 5,509,218 | 4/1996 | Arcan et al. | 36/28 X |
| 5,625,964 | 5/1997 | Lyden et al. . | |
| 5,713,140 | 2/1998 | Baggenstoss | 36/28 |
| 5,822,886 | 10/1998 | Luthi et al. . | |

*Primary Examiner*—M D Patterson
*Attorney, Agent, or Firm*—Ipsolon LLP

[57] ABSTRACT

An athletic shoe with an articulating heel which incorporates a plurality of linkage mechanisms that control heel dynamics. The linkage mechanisms couple a lower heel plate to a spaced apart upper heel plate. A resilient element is located between the upper heel plate and lower heel plate to dampen impact forces and resiliently maintain spacing between the upper and lower heel plates. The linkage mechanisms may be suitably configured alloy bars coupled to the upper and lower plates that constrain the upper and lower plates against motion along a heel transverse axis. Other embodiments of the linkage mechanisms include unitarily constructed panels having flexure joints. During running, the lower heel plate, or an outsole attached to the lower heel plate, will contact and frictionally engage the ground surface while the upper heel plate and footwear will continue forward as the heel articulates about the linkage mechanisms. The impact force will move the upper plate downward compressing the resilient element and the upper heel plate will move closer to, and forward of, the lower heel plate providing heel travel that attenuates the impact forces. The linkage mechanisms constrain the relative motion of the upper heel plate and the lower heel plate against motion transverse of the heel thus providing heel control. The heel dynamics can be further controlled by controlling the orientation of the heel relative to the footwear.

22 Claims, 3 Drawing Sheets

FOOTWEAR HAVING AN ARTICULATING HEEL PORTION

This application is a continuation in part of U.S. patent application Ser. No. 09/105,974, filed Jun. 26, 1998, which is a continuation of U.S. patent application Ser. No. 08/538,754, filed Oct. 2, 1995 (now abandoned).

BACKGROUND OF THE INVENTION

1. Field of the Invention

This invention pertains to the field of footwear and in particular pertains to athletic footwear.

2. Description of the Related Art

When running, a person pushes off on the toe of their foot, arcs their foot through the air and sets their foot down on the ground in front of their body. For most runners, their heel strikes first, and their foot pronates slightly as they roll forward onto the ball of the foot; they then repeat the process by pushing off on the ball of their foot or toes. This heel-to-toe motion is common among long-distance runners. When the heel strikes the ground, significant impact forces are created that must be absorbed by the runner and his shoes, preferably the latter. Without proper absorption mechanisms built into the shoe, these impact forces can create acute injuries.

At the moment of ground contact, the foot is generally inverted approximately 6 degrees, dorsi-flexed 10 degrees, and outwardly rotated 12 degrees. A 150 pound runner regularly generates impact forces in the order of 450 pounds force (3 G's).

To lessen a runner's potential injury by reducing the impact upon the runner, a running shoe must attenuate the impact. Since the impact force is the overall force divided by time of force application, the most efficacious method of absorbing shock is by extending the time of force application, and thereby lessening the impact upon the runner. This can be done by allowing for travel in the heel as it strikes the ground. This curtails the amount of shock communicated to the runner's body .

Some prior art running shoes address the problem of shock absorption by using a variety of micro-cellular foams, gels or air bladders, which offer minimal travel. Softer soles provide more cushion and shock absorption, but in so doing compromise the angular stability of the foot. Conversely, firmer soles better stabilize the foot, but provide commensurately less shock absorption.

SUMMARY OF THE INVENTION

The present invention overcomes the deficiencies of prior art footwear by incorporating a linkage mechanism that links two substantially rigid plates of the heel of the footwear heel. This linkage mechanism in the heel creates an articulating heel that provides significant vertical and longitudinal travel while also providing angular stability for control of pronation and supination. In this invention, upon ground impact of the footwear during running, a lower plate contacts the ground and comes to a stop due to friction with the ground surface while an upper plate continues to move forward and downward, which leads to significant vertical and longitudinal travel of the heel, while maintaining angular stability.

The aforementioned longitudinal travel attenuates longitudinal sheer forces. Longitudinal sheer forces occur when the foot comes in contact with the ground, which contact abruptly halts the forward motion of the foot. This sudden cessation of the foot's forward motion, coupled with the vertical impact, results in a net vector of force being transferred up through the leg at approximately 15 degrees from the vertical. In this invention, longitudinal sheer forces are curtailed due to the articulating heel displacing fore-aft and vertically upon impact, which more precisely addresses the net vector of impact force, while giving the runner a little extra length to his or her stride.

DESCRIPTION OF THE PREFERRED EMBODIMENTS

Figure 1:
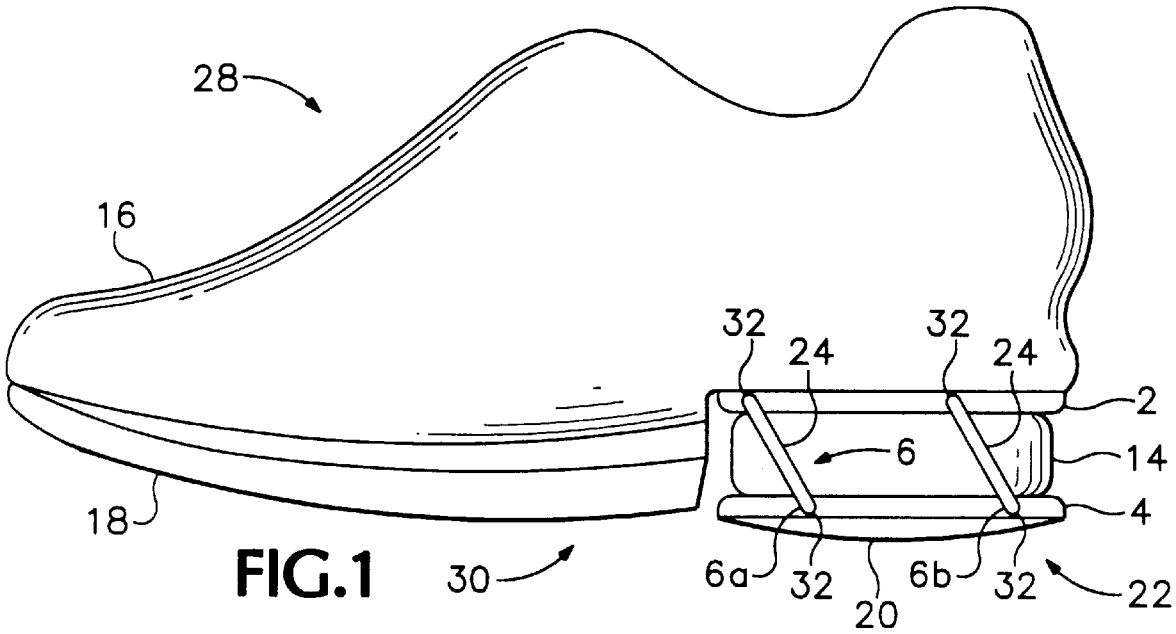
FIG. 1 is a side elevation view of a preferred embodiment of footwear of the present invention.

A first embodiment of the present invention is shown in FIG. 1. Footwear 28 includes an upper 16 and a sole 30. The sole further includes a foresole portion 18 and a heel 22 having an upper plate 2 and a lower plate 4 coupled by a plurality of linkage mechanisms 6*a* and 6*b* (collectively, linkage mechanisms 6). A resilient element 14 is located between the upper plate 2, lower plate 4 and linkage mechanisms 6.

Figure 2:
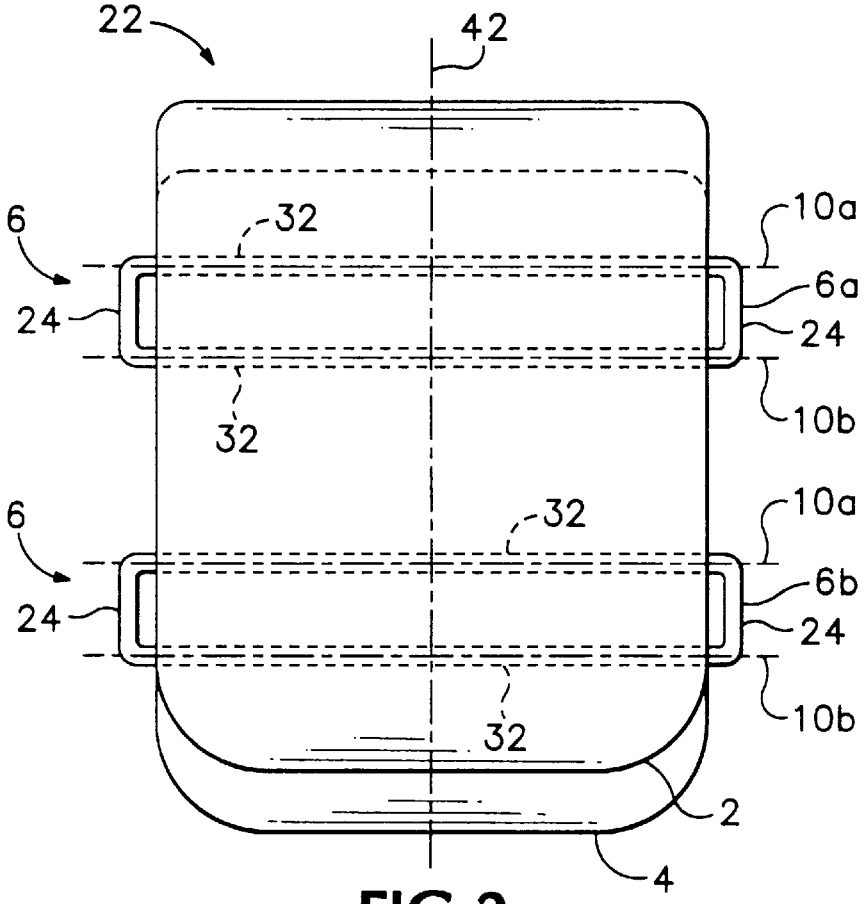
FIG. 2 is a top plan view of a heel of the footwear of FIG. 1.
Figure 3:
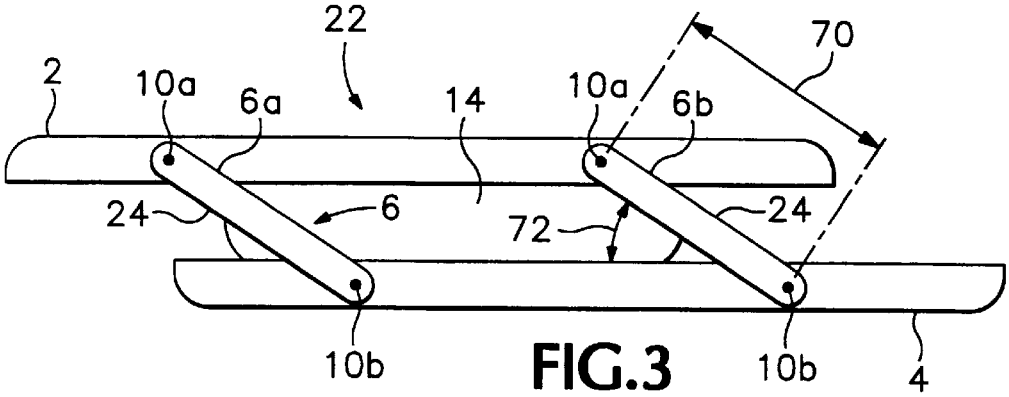
FIG. 3 is a side elevation view of the heel of FIG. 2 in a compressed state.

FIGS. 1–3 illustrate shaped rod-type linkage mechanisms 6*a* and 6*b*. The formed rod linkage mechanism 6*a* defines flexure axis 10*a* on the upper plate 2 and flexure axis 10*b* on the lower plate 4. Likewise, the formed rod linkage mechanism 6*b* defines flexure axes 10*a* and 10*b* on the upper plate 2 and lower plates 4, respectively. Each plate 2 and 4 can rotate about a respective flexure axis by pivoting on a respective linkage mechanism 6*a* and 6*b*. The flexure axes of this embodiment are collectively referred to as flexure axes 10.

Each formed rod linkage mechanism 6*a*, 6*b* articulates with the upper plate 2 and lower plate 4 of the heel 22. The upper plate 2 and lower plate 4 have cylindrical holes 32 for receiving the formed rod linkage mechanisms 6*a* and 6*b*. As the phantom lines in FIG. 2 illustrate, the formed rod linkage mechanisms 6*a* and 6*b* pass substantially transversely through the upper plate 2 and lower plate 4 through these cylindrical holes 32. The plates 2 and 4 can thus rotate on the linkage mechanisms 6 about the flexure axes 10. In a heel 22 having two formed rod linkage mechanisms 6*a* and 6*b*, as shown in FIGS. 1–3, the linkage mechanisms 6 constrain the plates 2 and 4 to move along a heel longitudinal axis 42 relative to each other and toward and away from each other. The flexure axes 10 will remain substantially parallel to one another as the plates move about the linkage mechanisms 6.

The formed rod linkage mechanisms 6*a*–6*b* can be made out of any formed alloy rod or material of similar performance characteristics. Preferably the diameter is 0.060 inches–0.090 inches. Preferably the cylindrical holes 32 have an inner diameter of not more than 0.010 inches greater than the outer diameter of the formed rod linkage mechanisms 6*a*–6*b*.

There can be one or more formed rod linkage mechanisms 6*a*–6*b*. The linkage mechanisms 6 provide a hinging dynamic at the flexure axes 10, allowing the lower plate 4 to pivot about the substantially rigid body 24 of the formed rod linkage mechanisms 6*a* and 6*b*. This maintains a substantially parallel orientation of the flexure axes 10 to each other, despite impact forces causing compression of the plates. This is desirable to the maintenance of angular stability—otherwise the foot could roll significantly, given the amount of travel (preferably greater than approximately 0.5 inches) this design allows.

In order to be substantially rigid, the upper plate 2 and lower plate 4 should be made from a relatively high-strength plastic or composite such as nylon or fiber-reinforced polypropylene (for its light-weight). A preferred thickness range is from 0.080 inches–0.100 inches, depending on the diameter of the formed rod linkage mechanisms 6*a*–6*b* used. The weight of these items favorably compares with the aggregate weight of standard systems, once the weights and volumes of the various standard heel counters and high-density plastics (used for heel counters and mid-soles) are factored in.

The upper plate 2 and lower plate 4 and linkage mechanisms 6 (or 8, described below) form an articulating frame, which allows for the use of low-density resilient elements 14, such as air bladders, EVA and neoprene. Conventional shoes rely on relatively high-density compounds in the heel in order to provide angular stability.

The underside of the lower plate 4 is preferably slightly arcuate, or provided with an arcuate outsole 20, to address the bio-mechanics of running. By having the area that initially makes contact with the ground right underneath the heel (striking under the inferior protuberance of the calcaneous bone), the initial force of impact is similar to the bio-mechanics of running barefoot on a soft surface (when the heel strikes just under the calcaneous). In this invention, the lever moment of the heel striking the ground is lessened, and rolling onto the ball of the foot is facilitated, while lessening the strain on the anterior muscles of the tibia. As the heel 22 of the shoe 28 is compressed more, it flexes back relative to the foot, increasing the lever moment after the initial impact. This enhances plantar-flexion at a critical point in the stride, allowing for greater fluidity and ease of heel-to-toe action.

Outsole 20 of a softer high-traction material is applied to or molded within the underside of the lower plate 4. This outsole does not need to be of a highly shock absorbent nature. The priorities here are good traction and wear-resistant characteristics.

There are a variety of methods for holding the linkage mechanisms 6*a*–6*b* laterally within the upper 2 and lower 4 plates. Preferably they would be insert-molded into the upper 2 and lower 4 plates, but in lieu of that, c-clips can be used, or the formed rod linkage mechanisms 6*a*–6*b* may simply be bent such that they're retained without additional help. The formed rod linkage mechanisms 6*a*–6*b* can only collapse towards the rear when under compression, due to the proximity of the foresole 18 or some portion thereof, and the rearward slope of the formed rod linkage mechanisms 6*a*. Another way of achieving the same result is to have the formed rod linkage mechanisms 6*a*–6*b* indented into the upper 2 and lower 4 plates such that the plates restrict movement at a given point. Many engineering-quality plastics will withstand the constant axial rotation the upper plate 2 and lower plate 4 need to withstand. Nylon is a good candidate, as it is used in bushings and bearings in many related sports applications.

Figure 4:
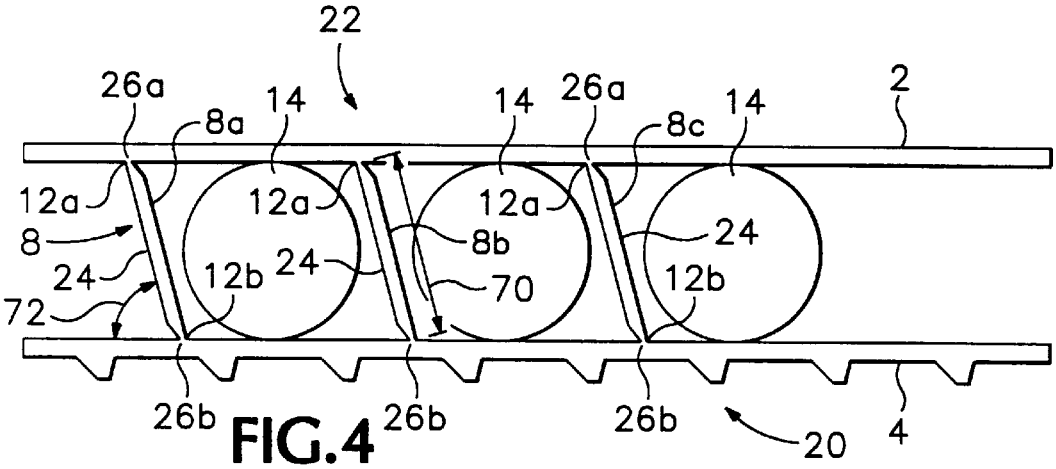
FIG. 4 is a side elevation view of an alternative embodiment of a heel of footwear of the present invention.
Figure 5:
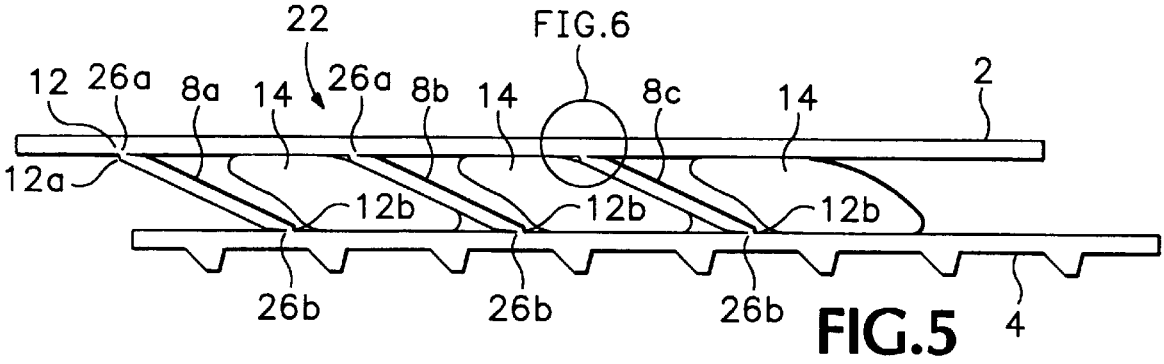
FIG. 5 is a side elevation view of the heel of FIG. 4 in a compressed state.
Figure 6:
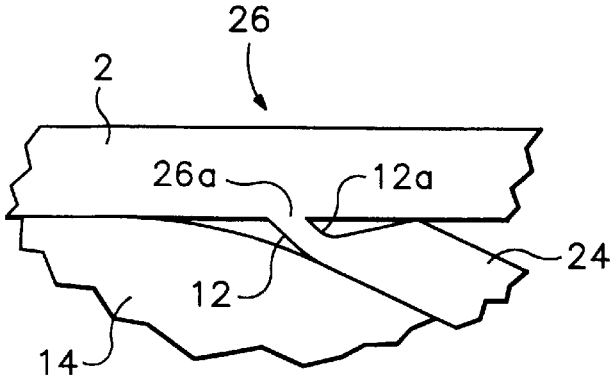
FIG. 6 is an enlarged side elevation view of a portion of the heel of FIG. 5 as taken along line 6—6.

In another embodiment (as shown in FIGS. 4, 5 and 6), the heel 22 can be extruded as a single piece having unitary construction. This allows the upper plate 2, lower plate 4 and the panel type linkage mechanisms 8*a*–8*c* to be fabricated as a single body. The resulting panel type linkage mechanisms 8*a*–8*c* have a substantially rigid body 24 and flexural couplings 26*a* and 26*b* located at opposed margins of the rigid body 24 and coupled to the upper 2 and lower plates 4. These flexural couplings 26*a* and 26*b* (collectively 26) define flexure axes 12*a* and 12*b*, respectively, where the flexure couplings couple to the upper 2 and lower 4 plates. The flexure couplings 26 allow a respective plate, 2 and 4, to pivot about a respective flexure axis 12. As in the formed rod linkage mechanisms 6 described above, the lower plate 4 pivots about the rigid body 24 of the linkage mechanisms 8 via flexure axes 12.

Alternatively, these flexible extruded profiles may be molded, milled, or fabricated in any other manner which allows for hinging motion of the rigid body 24 of the linkage mechanisms 8 via the flexure axes 12. Plastics, (generally of the softer variety, such as UHMW, polypropylene, or Hytrel®) are the preferred materials, but other materials may be suitable—essentially any material that provides low compression set, good kinetic memory, pliability, resistance to temperature, and appropriate rigidity may suffice.

Figure 8:
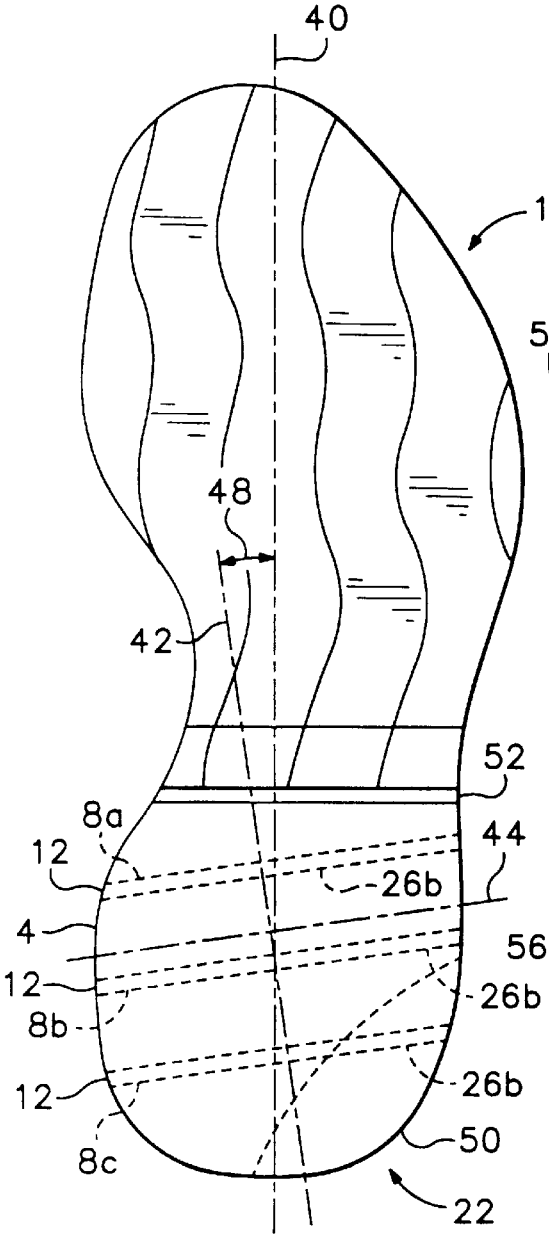
FIG. 8 is a bottom plan view of footwear of the present invention having the heel of FIG. 4.

As shown in FIG. 8, the flexure axes 12*a* and 12*b* of this embodiment are generally transverse to the longitudinal axis 40 of the footwear 28 and may be orthogonal or oblique (as previously mentioned above for the formed rod linkage embodiment), such that the unitary construction flexure axes 12 dictate the movement of the heel 22, be it largely fore-aft, or slightly transverse. They may be spaced at varying intervals, but are preferably placed at around 0.8 inches apart. The vertical height of the panel type linkage mechanisms 8 may also range widely, but is generally preferable around 1.25 inches. Being that the unitary construction flexure axes 12 are of lesser thickness than the rest of the shape, a hinging dynamic automatically occurs in this area. All other parts of the panel type linkage mechanism's 8*a*–8*c* body remain substantially unflexed.

The profiles of the upper 2 and lower 4 plates may be generally similar to the heel profiles of standard footwear. The lower plate 4 is preferably longitudinally detached from the foresole 18 and separated from the foresole by a space 52, located generally at a point around the junction of the runner's heel and arch—around the anterior portion of the calcaneous bone. This allows for free fore-aft and vertical articulation of the lower plate 4, while transferring the relatively dissipated vertical force to the ball of the foot, where the ensuing stride will begin.

With reference to FIG. 8, the footwear 28 is elongate having a footwear longitudinal axis 40. Further, the heel 22 defines a heel longitudinal axis 42 and a heel lateral axis 44. The heel longitudinal axis 42 may be arranged parallel to the footwear longitudinal axis 40 or the heel longitudinal axis may be arranged oblique to the footwear longitudinal axis at a predetermined angle 48. The relationship of the heel longitudinal axis to the footwear longitudinal axis affects the dynamic response of the heel, and in particular, controls the dynamic response of the lower plate 4 because the lower plate 4 is constrained to relative motion substantially along the heel longitudinal axis 42 by the linkage mechanisms 6 or 8.

Thus, when the heel longitudinal axis 42 is parallel to the footwear longitudinal axis 40, the lower plate 4 will translate along the footwear longitudinal axis during heel compression. However, as most runners contact the ground away from a centerline of the elongate footwear 28 in a contact region 50, it may be advantageous to arrange the heel longitudinal axis at a predetermined angle relative to the footwear longitudinal axis to constrain the lower plate 4 to translate along the predetermined angle relative to the footwear longitudinal axis to match a runner's natural stride.

Footwear of the present invention may be provided having various angles of orientation 48 of the heel longitudinal axis 42 (relative to the footwear longitudinal axis 40) to accommodate various runners, or footwear may be provided at a single optimum angle of orientation of the heel longitudinal axis. Alternatively, the heel may be coupled to the upper in a manner to permit adjustment of the orientation angle 48 of the heel longitudinal axis 42 to match the heel longitudinal axis (and thus the direction of translation of lower plate 4) to a particular runner based on empirical measurements of the runner.

As noted, the lower plate 4 translates relative to the upper plate 2 substantially along the heel longitudinal axis 42 during heel compression to attenuate impact forces due to running. The relative motion of the lower plate is constrained to motion substantially along the heel longitudinal axis by the linkage mechanisms 6 or 8. In addition, the linkage mechanisms 6 or 8 constrain the lower plate 4 against motion along the heel lateral axis 44, thus providing heel stability during heel compression.

Because the lower plate 4 is a smaller component as compared to the remainder of the heel 22 and footwear 28, it is conceptually easy to speak of the lower plate 4 moving relative to the upper plate 2 or the footwear 28. However, in heel strike impacts during running, the lower plate 4 will be stationary (relative to the ground) during heel compression because the lower plate 4 and an associated outsole 20 will first contact the ground during heel strike and will remain stationary relative to the ground due to friction between the ground and the outsole or lower plate 4. As the stride progresses, and the runner continues to shift weight onto the footwear, the lower plate 4 will remain stationary on the ground and the footwear 28, and upper plate 2, will proceed forwardly as the heel articulates along the flexure axes 10 or 12 (or single flexure axis 10 or 12 in the embodiment of FIG. 7). During this phase, the upper plate 2 will translate over the lower plate 4 substantially along the longitudinal heel axis 42 and the upper plate 2 will compress the resilient element 14 and move downward toward the lower plate 4, thus producing the often-referenced heel travel that attenuates the impact force of the heel strike. Because the lower plate 4 frictionally engages the ground at heel strike and the upper plate 2 and footwear 28 continue forward as the heel articulates about the flexure axes 10 or 12, the footwear of the present invention attenuates horizontal forces (those vector forces in the same plane as the ground surface over which the runner is running).

In contrast, prior art footwear contacts the ground at heel strike and friction between the ground and the outsole abruptly halts forward motion of the footwear, and the runner's foot, and creates a horizontal component to the impact force that stresses the runner's leg.

The bottom plate 4 may be arcuate somewhat fore-aft and/or laterally in order to better accommodate the rolling motion of the heel-toe action, and the upper plate 2 can reflect this change in shape in order to allow for proper functioning of the flexural coupling 26*a*–26*b* dynamic. The rest of the sole can be of standard design, as the articulating dynamic of the heel 22 does the bulk of shock absorption, and the foresole 18 merely provides a firm stable platform upon which the thrust of the ensuing stride can be applied. The heel 22 (or whatever part of the heel is articulating) is preferably thicker than the foresole 18, as this readies the heel for compression, and allows it to compress appreciably without dorsi-flexing the whole shoe.

The rear portion of the heel 22 need not extend outward from the rear of the upper, as this increases the dynamic lever moment which is produced when the heel displaces rear-wards on compression, creating a larger than necessary lever moment at the mid portion of the stride.

Different resilient elements 14, such as elastomers, gels, or air bladders, may be incorporated in the present invention. All these materials (and various combinations thereof) may be integrated into this system as a means of allowing for resilient travel of the heel, and subsequent rebound to its original position. The resilient elements 14 may be arranged such that they can be changed, thus tuning the dynamics of the shoe to the weight, running style, and preferred terrain of the runner. Such materials may also be used in the formed rod linkage mechanism 6 versions. Progressive dampening and travel variables can be manifest by incorporating different shapes, such as cylinder, parallelogram (cross-section), cored cylinder, cone, or other suitable shape. The inside of the upper 2 and lower plate 4 may be channeled or indented in order to allow for fore-aft rolling of relatively high-durometer elastomer cylinders, or spheroid forms.

Space between the upper 2 and lower plates 4 and the resilient elements 14 may filled with a filler 34, such as a closed-cell foam or cellular material. In general, it is preferred that these spaces be filled with the aforementioned foam or cellular material formed around the resilient elements. A flexible baffle may be joined to the heel 22 to achieve the same results. Resilient elements 14 which range in density from 10–80 shore-oo durometer are preferable for providing elasticity and rebound. Air bladders are excellent for rebound and dampening, particularly if they're shaped to allow for some longitudinal rolling or sheer. Open cell foam may constitute the inside of the air bladders. Whatever material is used should tolerate both sheer and compressive forces, with low hysteresis.

In addition, the filler may by used in conjunction with a resilient element 14 to provide a heel 22 having a nonlinear response during heel compression. That is, the filler 34 may be a relatively low density material that yields easily and the resilient element 14 may be a relatively higher density material that yields less than the filler to a given force. Thus, the filler provides minimal resistance to heel compression during the onset of compression. But, as the compression increases, the resilient element provides greater resistance to further compression. This combination may be useful to prevent a heel from bottoming out (maximum compression at which the resilient materials, e.g., 34 and 14, can not compress further) during use, particularly for heavy runners.

Figure 7:
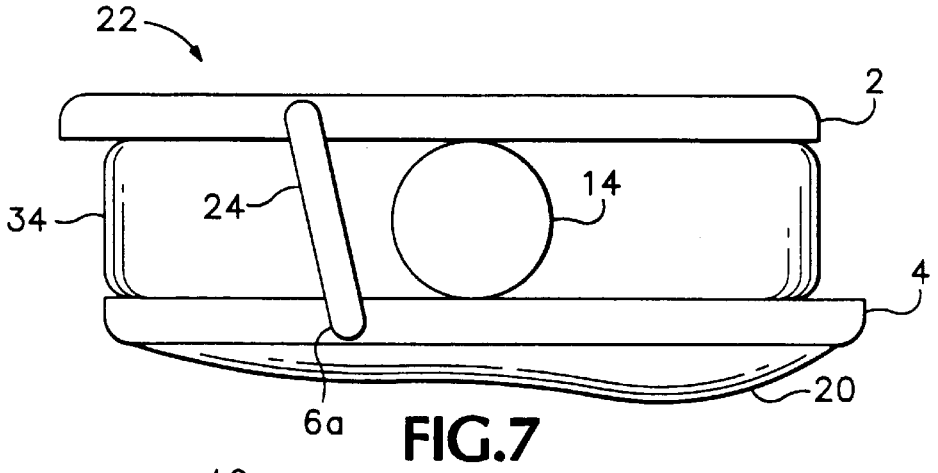
FIG. 7 is a side elevation view of another alternative embodiment of a heel of footwear of the present invention.

FIG. 7 illustrates how single formed rod linkage mechanism 6*a* can be used. This may be desirable in some instances, as it offers many of the benefits of multiple formed rod linkage mechanisms 6 or panel type linkage mechanisms 8, while allowing for further tuning of longitudinal flexibility. Cantilevered (as shown in FIG. 7) or other configurations are also possible with this version.

The upper and lower plates 2,4 may be channeled, honeycombed, or hollow in parts, or even consist of multiple pieces—anything that allows for light-weight concurrent with adequate rigidity. The upper 2 and lower 4 plates act as a firm attachment for the linkage mechanisms 6, 8, and may be replaced with anything that provides the same function.

If air bladders are the resilient elements 14, they may incorporate an integral valve such as those found on soccer balls, which allows for adjustment of pressure. Various degrees of bladder-wall elasticity can be used to dial in the right performance characteristics of the bladders, since the volume of air is variable.

The resilient elements 14, may also be interchangeable, allowing for increased adjustment potential. The resilient elements 14 can include anything that offers rebound and damping characteristics, such as gels, springs, torsion bars, air bladders, and various combinations thereof.

The entire heel 22 (or portion thereof can be mounted to the rest of the shoe such that its position is adjustable fore-aft, laterally or rotationally. This would allow for individual tuning of the lever moment applied to the heel upon heel strike. There are a variety of mechanisms which would allow the heel to be dynamically adjusted in regards to thickness by applying tension or compressive forces, which would in turn change the angle of the linkage mechanisms 6 or 8.

Each linkage mechanism 6 or 8 has a length 70 and an incident angle 72 formed between the linkage mechanism body 24 and an inner surface of the plates 2, 4. As discussed, the incident angle 72 may be varied to control the amount of relative longitudinal travel between the upper plate 2 and the lower plate 4 during compression. Also, for a given incident angle 72, the length 70 may be varied to control heel response during running. Further, individual linkage mechanisms 6 or 8 may have varied lengths 70 within the same heel, with identical or varying incident angles 72.

By way of example, in the embodiment of FIGS. 1–3, the linkage mechanism 6*b* may have a shorter length 70 than linkage mechanism 6*a* and both linkage mechanisms 6*a*, 6*b* may have identical incident angles 72. Compressive forces would then cause a trailing portion (a portion near the most rearward edge of the heel) of the plates 2 and 4 to move together more quickly than a leading portion of the plates. During compression of the heel, the upper flexure axes 10*a* move circumferentially about the lower flexure axes 10*b* (axes 26*a* and 26*b* in the embodiment of FIGS. 4–6) and the upper flexure axes must move through the same arc length because the axes are coupled by the upper plate 2. Thus, when one linkage mechanism length is shorter than other linkage mechanism lengths in the same heel, the shorter linkage mechanism will travel through its respective incident angle 72 more quickly than the longer linkage mechanism and the upper plate 2 and lower plate 4 will come together more quickly in the region of the shorter linkage mechanism.

In a related example, again referring to FIGS. 1–3, linkage mechanism 6*b* may have a shorter length 70 than linkage mechanism 6*a* and linkage mechanism 6*b* may have a greater incident angle 72 than linkage mechanism 6*a* so as to make the upper plate 2 substantially parallel to the lower plate 4. However, the rearward linkage mechanism 6*b* would move through its incident angle more quickly than linkage mechanism 6*a* because of its shorter length. Substantial control of heel response may be achieved by modifying these parameters.

The formed-rod linkage mechanisms 6 or 8 could also be made to act as torsion bars, in which case no resilient elements 14 would be needed. This could be achieved by offsetting the flexure axes 10, 12 a little from each other (on the longitudinal plane) so that a twisting dynamic would take place, which would act as a spring to force the upper 2 and lower 4 plates apart.

Linkage mechanisms 6 or 8 may also have their angles reversed, such that they collapse towards the front of the shoe. This can be advantageous in some circumstances.

Figure 9:
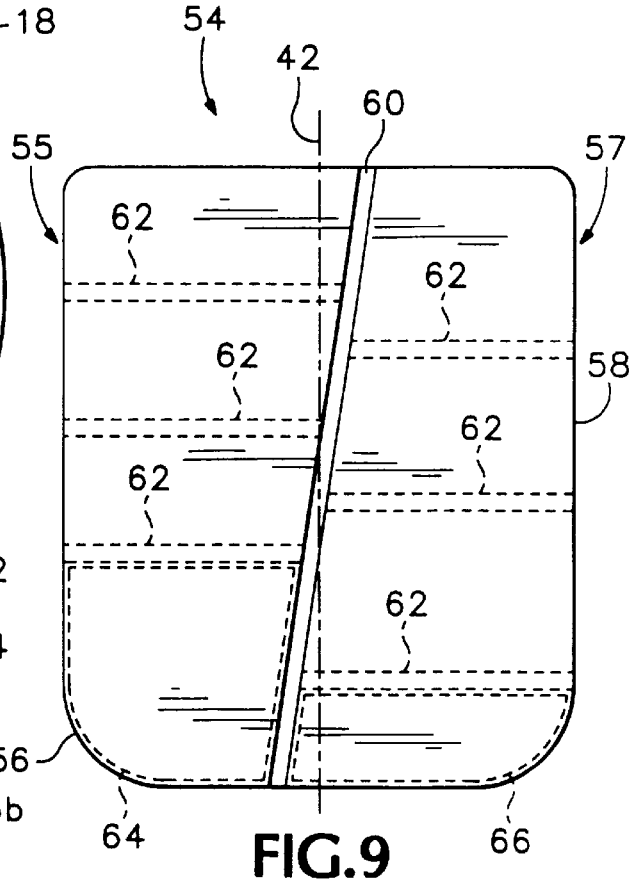
FIG. 9 is a bottom plan view of another alternative embodiment of a heel of the present invention.

FIG. 9 is a bottom plan view of a bifurcated heel 54, an alternative embodiment of the present invention. The bifurcated heel 54 includes a medial portion 55 having a medial lower plate 56 separated from a lateral portion 57 having a lateral lower plate 58 by a slit 60. Linkage mechanisms 62 connect the lower medial and lateral plates 56, 58 to an upper plate (not shown) that is fixedly coupled to a footwear upper as in the previously discussed embodiments. In a bifurcated heel 54, the lateral and medial portions 55 and 57 may be provided with linkage mechanisms 62 having different properties, locations, or quantity in order to provide a different response in the lateral portion 57 versus the medial portion 55. For example, because many runners heel strike at a rearward lateral corner of their heel, the lateral portion may be provided with a greater number of linkage mechanisms, stiffer mechanisms, or linkage mechanisms located more rearwardly as compared to the medial portion. Conversely, to prevent excessive pronation, the medial portion could be provided with stiffer linkage mechanisms, or linkage mechanisms having the other desired properties as identified above.

Additionally, medial resilient elements 64 (only one shown) and lateral resilient elements 66 (only one shown) may be provided having different properties such as density, hysteresis, and weight to further customize differences in the response of the medial portion versus the lateral portion. Other design elements disclosed above may also be incorporated into the bifurcated heel design.

As shown in FIG. 9, the slit 60 is elongate and its longitudinal axis (not separately numbered) is oblique to the heel longitudinal axis 42. Alternatively, the slit's longitudinal axis may be parallel to the heel longitudinal axis 42 or orthogonal to the heel longitudinal axis. Additionally, the slit need not be linear, but may have a curvilinear path as viewed in plan.

This specification sets forth the best mode for carrying out the invention as known at the time of filing the patent application and provides sufficient information to enable a person skilled in the art to make and use the invention. The specification further describes materials, shapes, configurations and arrangements of parts for making and using the invention. However, it is intended that the scope of the invention shall be limited only by the language of the claims and the law of the land as pertains to valid U.S. patents.

I claim:

1. Footwear, comprising:

(a) an elongate upper having a forwardly located toe portion;

(b) a forefoot sole coupled to the upper proximate the toe portion, the forefoot sole having a lowermost outsole portion;

(c) a heel coupled to the upper and having a lowermost outsole portion, the heel being separated from the forefoot sole by a discontinuity in the outsole portions, the heel further including:

(i) a first substantially rigid plate;

(ii) a second substantially rigid plate; and (iii) a linkage mechanism that is coupled to the first plate and defining a first flexure axis proximate the first plate, and the linkage mechanism is coupled to the second plate and defining a second flexure axis proximate the second plate, wherein the first flexure axis is located forwardly of the second flexure axis so that ambulation impact forces on the heel causes the heel to flex at the flexure axes and move the second plate away from the forefoot sole.

2. The footwear of claim 1 further comprising a second linkage mechanism that is coupled to the first and second plates and that defines a third flexure axis proximate the first plate and a fourth flexure axis proximate the second plate, wherein the third flexure axis is located forwardly of the fourth flexure axis.

3. The footwear of claim 2 further comprising a third linkage mechanism coupled to the first and second plates that defines a fifth flexure axis proximate the first plate and a sixth flexure axis proximate the second plate, and wherein the fifth flexure axis is located forwardly of the sixth flexure axis.

4. The footwear of claim 1, wherein the first linkage mechanism is a configured rigid bar.

5. The footwear of claim 1, wherein the first linage mechanism is a planar panel.

6. The footwear of claim 1, wherein the first linkage mechanism is a panel extending substantially transversely across the heel and the panel is of unitary construction with the first and second plates.

7. The footwear of claim 1, wherein the first linkage mechanism is a panel having a thickness, and the first flexure axis is located along a portion of the panel that is least thick.

8. The footwear of claim 1, wherein the first and second plates include a leading margin and a trailing margin, the leading margin being forward of the trailing margin, and wherein the first flexure axis is located rearward of the first plate leading margin and the second flexure axis is located forward of the second plate trailing margin.

9. The footwear of claim 1, further comprising a resilient element located between the first and second plates.

10. An improved heel for footwear, the footwear having an elongate sole coupled to an upper, the sole having a forefoot portion and the improved heel, and the forefoot portion and heel including a ground contact portion located along a lower surface of the forefoot portion and the heel, the ground contact portion of the heel being separated from the ground contact portion of the forefoot portion by a lower surface discontinuity, the improvement comprising the heel having a first substantially rigid plate that is coupled to the upper, a second substantially rigid plate and linkage means that couple the second plate to the first plate such that ambulation forces move the second plate away from the forefoot portion, thereby attenuating horizontal and vertical impact forces.

11. The improved heel of claim 10, further comprising a resilient element located between the first and second plates.

12. The improved heel of claim 10, wherein the linkage means is of unitary construction with the first and second plates.

13. The improved heel of claim 10, the improvement further comprising a third substantially rigid plate and second linkage means that couple the third plate to the first plate such that ambulation forces move the third plate away from the forefoot portion and the third plate moves independently of the second plate.

14. Footwear having an upper coupled to an elongate sole, the sole including a forwardly located forefoot portion and a rearwardly located heel, the heel comprising:

(a) an upper plate coupled to the footwear upper;

(b) a first linkage mechanism that is pivotally coupled to the first plate along a first pivot axis; and (c) a lower plate pivotally coupled to the first linkage mechanism along a second pivot axis, the lower plate being spaced apart from the upper plate by the first linkage mechanism;

(d) wherein the lower plate is separated from the forefoot portion so that the lower plate can move independently of the forefoot portion, and the first pivot axis is located forwardly of the second pivot axis and the linkage mechanism is substantially rigid so that impact ambulation forces cause the second plate to pivot about the second pivot axis and the linkage mechanism to pivot about the first pivot axis so that ambulation forces move the second plate rearward and toward the first plate.

15. The footwear of claim 14, wherein the upper plate, lower plate, and first linkage mechanism are substantially rigid so that substantially all heel deformation occurs at the first and second pivot axes.

16. The footwear of claim 14, further comprising a second linkage mechanism that is pivotally coupled to the upper plate along a third pivot axis and is coupled to the lower plate along a fourth pivot axis, the third pivot axis being located forward of the fourth pivot axis so that ambulation forces move the second plate rearward and toward the first plate.

17. The footwear of claim 16, further comprising a third linkage mechanism that is pivotally coupled to the upper plate along a fifth pivot axis and is coupled to the lower plate along a sixth pivot axis, the fifth pivot axis being located forward of the sixth pivot axis, so that ambulation forces move the second plate rearward and toward the first plate.

18. The footwear of claim 14, wherein the upper plate is a first length along the longitudinal direction and the lower plate is a second length along the longitudinal direction, and a distance from the first pivot axis to the second pivot axis is a third distance, and the third distance is less than the first and second distances.

19. The footwear of claim 14, wherein the upper and lower plates include respective leading margins and trailing margins, the leading margins being forward of the trailing margins, and wherein the first pivot axis is located rearward of the upper plate leading margin and the second pivot axis is located forward of the lower plate trailing margin.

20. The footwear of claim 14, wherein the first linkage mechanism is a panel having upper and lower margins that couple to the upper and lower plates respectively, wherein the first and second pivot axes are located along portions of the panel that are thinner than other portions of the panel so that heel deformation due to ambulation forces occurs along the first and second pivot axes.

21. The footwear of claim 14, further comprising a second linkage mechanism coupled to the upper plate along a third pivot axis, and a lateral lower plate coupled to the second linkage mechanism along a fourth pivot axis, wherein the lateral lower plate can move independently of the lower plate and the lateral lower plate is substantially co-planar with the lower plate.

22. The footwear of claim 14, further comprising a resilient member located between the upper and lower plates that urges the upper and lower plates apart.

* * * * *